US008746676B2

(12) United States Patent
Ota

(10) Patent No.: US 8,746,676 B2
(45) Date of Patent: Jun. 10, 2014

(54) SHEET FEEDING DEVICE AND IMAGE FORMING APPARATUS

(71) Applicant: Canon Kabushiki Kaisha, Tokyo (JP)

(72) Inventor: Sho Ota, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 13/687,351

(22) Filed: Nov. 28, 2012

(65) Prior Publication Data

US 2013/0140758 A1 Jun. 6, 2013

(30) Foreign Application Priority Data

Dec. 5, 2011 (JP) ..... 2011-265733

(51) Int. Cl.
*B65H 3/06* (2006.01)

(52) U.S. Cl.
USPC ..... 271/114; 271/115

(58) Field of Classification Search
USPC ..... 271/114, 115
See application file for complete search history.

(56) References Cited

U.S. PATENT DOCUMENTS

| | | | | |
|---|---|---|---|---|
| 4,444,385 | A * | 4/1984 | Berry | 271/22 |
| 4,475,733 | A | 10/1984 | Benson | |
| 4,496,144 | A * | 1/1985 | Perun et al. | 271/114 |
| 5,222,723 | A * | 6/1993 | Ijuin | 271/10.11 |
| 5,531,435 | A * | 7/1996 | Momose | 271/258.03 |
| 6,685,183 | B2 * | 2/2004 | Kim | 271/114 |
| 7,673,869 | B2 * | 3/2010 | Hamahashi | 271/10.03 |
| 8,302,956 | B2 * | 11/2012 | Matsushima et al. | 271/114 |

* cited by examiner

*Primary Examiner* — Stefanos Karmis
*Assistant Examiner* — Ernesto Suarez
(74) *Attorney, Agent, or Firm* — Fitzpatrick, Cella, Harper & Scinto

(57) ABSTRACT

Provided are a sheet feeding device with improved separating/feeding performance. The sheet feeding device includes a sheet storage portion, a pickup roller which feeds the sheet, a driving motor which rotates the pickup roller, a feed roller and a separating roller which separate and feed the sheet, and a drive transmission mechanism which when the pickup roller abuts on the surface of the sheet accommodated in the sheet storage portion to feed the sheet, allows the pickup roller to perform intermittent rotation that alternately perform rotation and stop twice or more while one sheet is fed. The drive transmission mechanism is connected to the driving motor and includes an input gear having a plurality of protrusions and a regulating portion which is engaged with the protrusions of the input gear to regulate the rotation of the input gear.

4 Claims, 8 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more specifically, to a sheet feeding device that separately feeds a sheet one by one and an image forming apparatus including the same.

2. Description of the Related Art

In the related art, an image forming apparatus such as a printer or a copying machine includes a sheet feeding device that separately feeds a sheet accommodated in a sheet storing portion one by one and the sheet feeding device includes a pickup portion that abuts on the sheet accommodated in the sheet storing portion to feed the sheet. As the pickup portion, for example, a technique that rotates a paddle wheel to apply an impact power on a sheet to separate the sheet and feed the separated sheet is suggested (see U.S. Pat. No. 4,475,733).

Here, a sheet feeding device that discharges the sheet using the paddle wheel is illustrated in FIG. 8. As illustrated in FIG. 8, the above-described sheet feeding device includes a paddle wheel 100 having a plurality of blades 101 and an energy storage portion 102 that abuts on the plurality of blades 101 to store energy in the plurality of blades 101. If the conveying operation of the sheet S starts, the paddle wheel 100 is rotated and the plurality of blades 101 is bounced from the energy storage portion 102 so that the bounced blades 101 come in contact with the sheet S to apply an impact power to the sheet S. Thus, the sheet S is separated to be fed in a sheet feeding direction.

However, in a state where it is difficult to separate the combined sheets due to cutting burr that occurs at an edge of a sheet caused by a cutting trouble when the sheet is manufactured, it may be difficult to separate the sheets S to feed the sheet even by rotating the plurality of blades 101.

Further, in a method that rotates the pickup roller to feed the sheet, even though a separating portion is provided in the downstream of the pickup roller, it may be difficult to separate the sheets when the sheets that overlap with each other enter the separating portion at once. Therefore, when the pickup roller feeds the sheet, it is required to loosely feed the sheet one by one to surely separate the sheets by the separating portion.

However, in the sheets combined at an edge by the cutting burr, it is difficult to divide the sheets one by one using the pickup roller so that the separating portion cannot sufficiently separate the sheets.

It is desirable to provide a sheet feeding device with an improved separating and feeding performance that separately feeds a sheet accommodated in a sheet storage portion one by one and an image forming apparatus including the same.

SUMMARY OF THE INVENTION

A sheet feeding device according to the present invention includes: a sheet storage portion which accommodates a sheet; a pickup roller which abuts on a surface of the sheet accommodated in the sheet storage portion to feed the sheet; a driving motor which drives the pickup roller; a separating/feeding portion which separates and feeds the sheet fed by the pickup roller; and a drive transmission mechanism which, when the pickup roller abuts on the surface of the sheet accommodated in the sheet storage portion to feed the sheet, allows the pickup roller to perform intermittent rotation that alternately perform rotation and stop twice or more while one sheet is fed. The drive transmission mechanism is connected to the driving motor and includes an input gear having a plurality of protrusions and a regulating portion which is engaged with the protrusions of the input gear to regulate the rotation of the input gear, and the drive transmission mechanism stops the rotation of the pickup roller when the regulating portion is engaged with the protrusions of the input gear to regulate the rotation of the input gear, and rotates the pickup roller by rotating the input gear to transmit the drive from the driving motor to the pickup roller when the regulating portion is disengaged from the protrusion.

According to the present invention, while feeding one sheet, by performing intermittent rotation which alternately rotates or stops to rotate the pickup roller at least two times, it is possible to improve a separation and feeding performance that separately feeds the sheet accommodated in the sheet storage portion one by one.

Further features of the present invention will become apparent from the following description of exemplary embodiments with reference to the attached drawings.

BRIEF DESCRIPTION OF THE DRAWINGS

FIG. 3 is a view illustrating an input gear when a solenoid of the separating/feeding unit according to the embodiment is on.

DESCRIPTION OF THE EMBODIMENTS

Hereinafter, an image forming apparatus including a sheet feeding device according to an embodiment of the present invention will be described with reference to accompanying drawings. The image forming apparatus according to the embodiment of the present invention is an image forming apparatus that includes a sheet feeding portion as a sheet feeding device that separately feeds a sheet one by one such as a copying machine, a printer, a facsimile, and a multifunctional peripheral.

Figure 1:
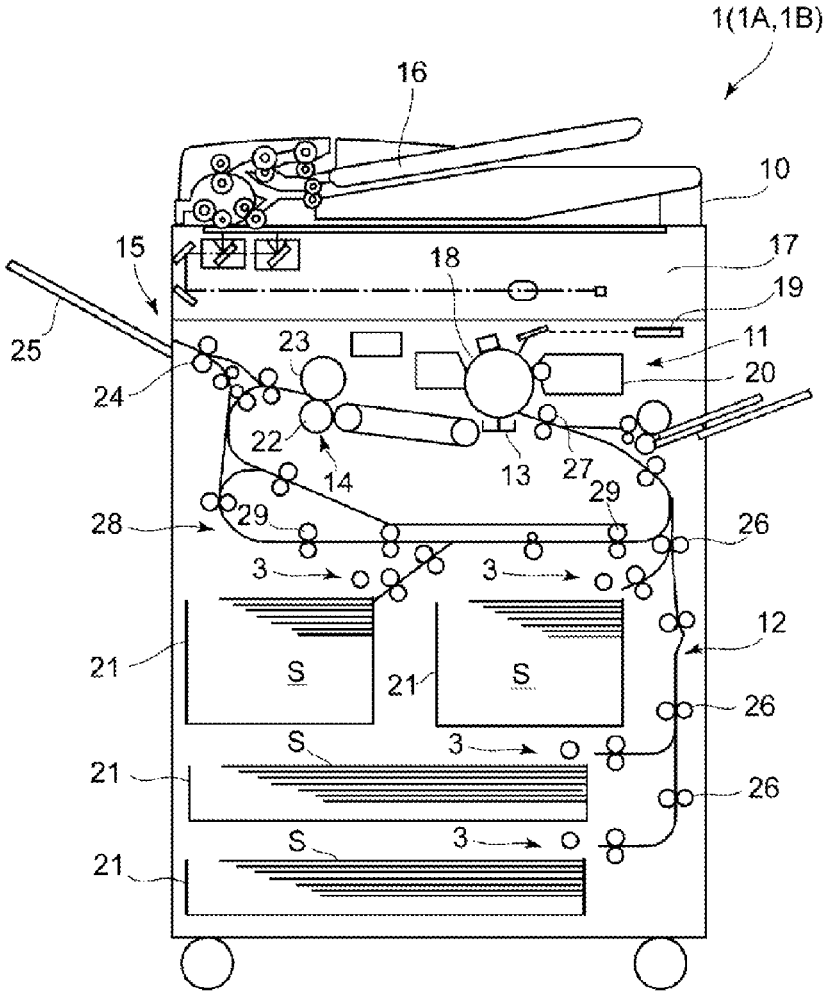
FIG. 1 is a cross-sectional view schematically illustrating an entire structure of an image forming apparatus according to an embodiment of the present invention.

The image forming apparatus 1 according to the embodiment of the present invention will be described with reference to FIGS. 1 to 6. First, a schematic configuration of the image forming apparatus 1 will be described with reference to FIG. 1. FIG. 1 is a cross-sectional view schematically illustrating an entire structure of the image forming apparatus 1.

As illustrated in FIG. 1, the image forming apparatus 1 includes an image reading portion 10 that reads an image to be formed on a sheet S, an image forming portion 11 that forms an image, a sheet feeding portion 12 that feeds the sheet S, and a transferring portion 13 that transfers the image onto the sheet S. The image forming apparatus 1 further includes a fixing portion 14 that fixes the image formed on the sheet S and a discharging portion 15 that discharges the sheet S on which the image is fixed.

The image reading portion 10 is disposed at an upper part of the image forming apparatus 1 and includes an original feeding portion 16 that feeds an original and an original reading portion 17 that reads image information of the original fed by the original feeding portion 16. The image forming portion 11 is disposed below the image reading portion 10 and includes a photosensitive drum 18 on which a toner image is formed and a laser scanner portion 19 that irradiates laser light onto the photosensitive drum 18 to form an electrostatic latent image. Further, the image forming portion 11 includes a development portion 20 that visualizes the electrostatic latent image formed on the photosensitive drum 18 as a toner image.

The sheet feeding portion 12 is disposed at a lower part of the image forming apparatus 1 and includes a sheet storage portion 21 that loads the sheet S so as to accommodate the sheet and a separating/feeding unit 3 that separates and feeds the sheet accommodated in the sheet storage portion 21. Further, the separating/feeding unit 3 of the sheet feeding portion 12 will be described below in detail.

The transferring portion 13 is disposed below the photosensitive drum 18. The fixing portion 14 is disposed in the downstream of the transferring portion 13 and includes a fixing roller 22 having a heater mounted therein and a pressure roller 23 that is pressed to the fixing roller 22. The discharging portion 15 is disposed in the downstream of the fixing portion 14 and includes a pair of discharge rollers 24 that discharges the sheet S to the outside of the device and a discharge tray 25 on which the sheet S which is discharged to the outside of the device is loaded.

Next, an image forming job of the image forming apparatus 1 according to the embodiment configured as described above will be described. If the image forming job of the image forming apparatus 1 starts to allow the original reading portion 17 to read an image of an original which is fed by the original feeding portion 16, image information is transmitted to the image forming portion 11 as an image information signal. When the image information signal is transmitted to the image forming portion 11, the laser scanner portion 19 irradiates the laser light onto a surface of the photosensitive drum 18 according to the image information signal. Thus, the surface of the photosensitive drum 18 which is uniformly charged at a potential having a predetermined polarity is exposed and the electrostatic latent image is formed on the surface of the photosensitive drum 18. If the electrostatic latent image is formed on the surface of the photosensitive drum 18, the development portion 20 develops the electrostatic latent image to be visualized as a toner image.

In parallel with the toner image forming operation, the sheet S accommodated in the sheet storage portion 21 is separated and fed by the separating/feeding unit 3 one by one and then conveyed in the downstream by a pair of conveying rollers 26. The sheet is conveyed to the transferring portion 13 by a pair of registration rollers 27 at a predetermined timing. When the sheet S is conveyed to the transferring portion 13, the toner image formed on the photosensitive drum 18 is transferred onto the sheet S by a transfer bias applied to the transferring portion 13 so that the toner image is formed on the sheet S.

The sheet S on which the toner image is transferred is conveyed from the transferring portion 13 to the fixing portion 14 and receives heat and pressure by the fixing roller 22 and the pressure roller 23 so that the toner is melted and color-mixed to be fixed as an image. Thereafter, the sheet S on which the image is fixed is discharged to the discharge tray 25 by the pair of discharge rollers 24 provided in the downstream of the fixing portion 14 and the image forming job is completed.

Further, for forming an image on both sides of the sheet S, after an unfixed toner image is fixed on the sheet S by the fixing portion 14, before discharging the sheet to the discharge tray 25 by the pair of discharge rollers 24, the pair of discharge rollers 24 are reversely rotated to convey the sheet S to a duplex conveying path 28. The sheet S is reversed by conveying the sheet S to the duplex conveying path 28 and the reversed sheet S is re-conveyed to the image forming portion 11 by a plurality of conveyance rollers 29 provided in the duplex conveying path 28 and the above-mentioned operations are repeated.

Figure 2:
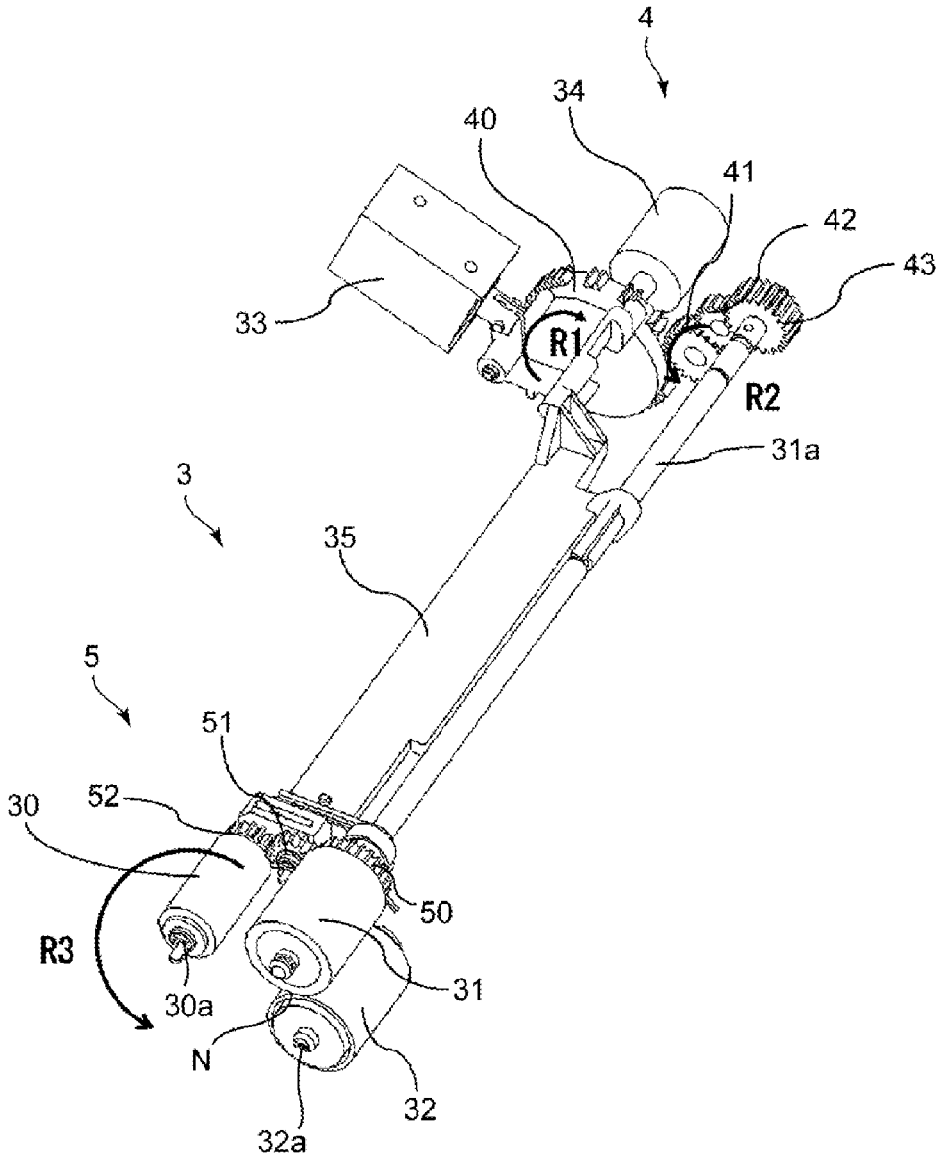
FIG. 2 is a perspective view illustrating a separating/feeding unit of a sheet feeding portion according to the embodiment.
Figure 3:
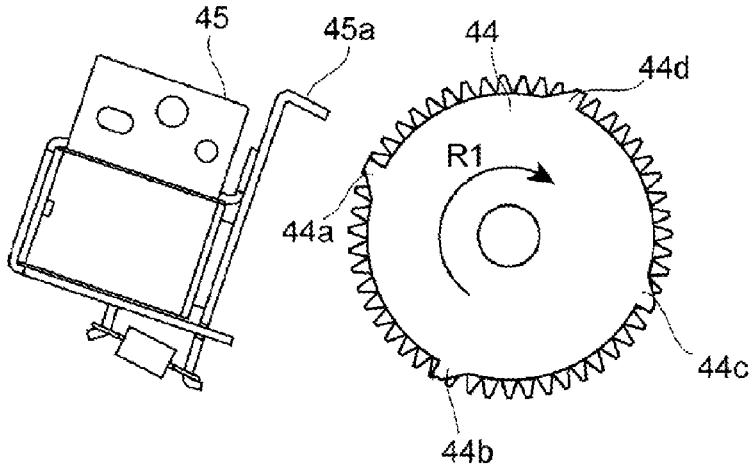

Next, the separating/feeding unit 3 of the sheet feeding portion 12 according to the embodiment will be described in detail with reference to FIGS. 2 to 6. First, the configuration of the separating/feeding unit 3 will be described with reference to FIGS. 2 and 3. FIG. 2 is a perspective view illustrating the separating/feeding unit 3 of the sheet feeding portion 12 according to the embodiment and FIG. 3 is a front view illustrating an input gear 44 used for the separating/feeding unit 3 according to the embodiment.

As illustrated in FIG. 2, the separating/feeding unit 3 includes a pickup roller 30, a feed roller 31 and a separating roller 32 as a separating feeder, a solenoid 33, a driving motor 34, a first drive transmission mechanism 4, and a second drive transmission mechanism 5.

The pickup roller 30 is disposed above the sheet S accommodated in the sheet storage portion 21 and abuts on a surface of the sheet S to feed the sheet S in a sheet feeding direction. The feed roller 31 is disposed in the downstream of the sheet feeding direction of the pickup roller 30 and is fixedly supported at a leading edge of a feed roller shaft 31*a* which extends in a direction perpendicular to the sheet feeding direction. The separating roller 32 is supported by a separating roller shaft 32*a* which is parallel to the feed roller shaft 31*a* and pressed with the feed roller 31 to form the separating portion together with the feed roller 31. The sheet S which is fed by the pickup roller 30 is separated one by one by a separating nip N which is a pressed portion of the feed roller 31 and the separating roller 32 in the separating portion and fed in the sheet feeding direction. The driving motor 34 generates a driving force to rotate the pickup roller 30 and the feed roller 31.

The solenoid 33 is connected to the pickup roller 30 through a rotational support member 35 which is rotatably supported to the feed roller shaft 31*a*. By the operation of the solenoid 33, the rotational support member 35 rotates around the feed roller shaft 31*a* and the pickup roller 30 is moved between an abutting position where the pickup roller 30 abuts on the surface of the sheet S and a retraction position where the pickup roller 30 is retracted from the abutting position to the upper portion.

Figure 5:
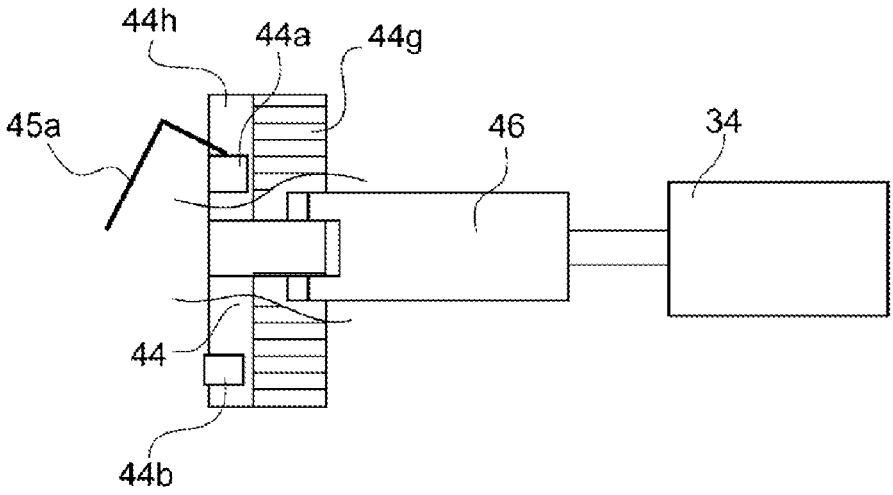
FIG. 5 is a view schematically illustrating a torque limiter of the separating/feeding unit according to the embodiment.

The first drive transmission mechanism 4B includes the input gear 44 which is connected to the driving motor 34, a flapper solenoid 45 as a regulating portion that is capable of regulating the rotation of the input gear 44, an intermediate gear 41 which is engaged with the input gear 44, a first gear 42, and a second gear 43. Further, as illustrated in FIG. 5, the driving motor 34 and the input gear 44 are connected through the torque limiter 46. Even when the driving motor 34 rotates by the torque limiter 46, the input gear 44 is regulated by the regulating portion which will be described below so as not to rotate so that the driving motor 34 runs idle to block the transmission of the rotation.

The regulating portion that regulates the rotation of the input gear 44 will be described. The input gear 44, as illustrated in FIG. 5, includes a gear portion 44*g* and a circular disk portion 44*h* close to the gear portion 44*g* in the axial direction. As illustrated in FIG. 3, four protrusions 44*a*, 44*b*, 44c, and 44*d* are provided in the circular disk portion 44h. The flapper solenoid 45 includes a solenoid projection 45*a* which is engageable with the protrusions 44*a* to 44*d* of the input gear 44 and allows the solenoid projection 45*a* to be engaged with the protrusions 44*a* to 44*d* to stop the rotation of the input gear 44. The torque limiter 46 described above is provided in the transmission route of the driving motor 34 and the input gear 44 so that when the rotation of the input gear 44 is stopped by the flapper solenoid 45, the driving force which is transmitted from the driving motor 34 to the input gear 44 is blocked.

The second drive transmission mechanism 5 transmits the driving force of the driving motor 34 which is transmitted to the feed roller shaft 31*a* through the first drive transmission mechanism 4 to the pickup roller 30 and the feed roller 31. The second drive transmission mechanism 5 includes a feed gear 50 which is fixed to the feed roller shaft 31*a*, a transmission gear 51 which is engaged with the feed gear 50, and a pickup gear 52 which is engaged with the transmission gear 51 and fixed to the pickup roller shaft 30*a*. The separating roller 32 is attached to the separating roller shaft 32*a* through a torque limiter which is not illustrated. If a predetermined rotation torque is applied to the separating roller 32, the separating roller 32 is driven by the feed roller 31 to rotate. Further, instead of the separating roller, a retard roller which is applied with the drive force to reversely rotate to separate the sheet may be used.

Figure 7:
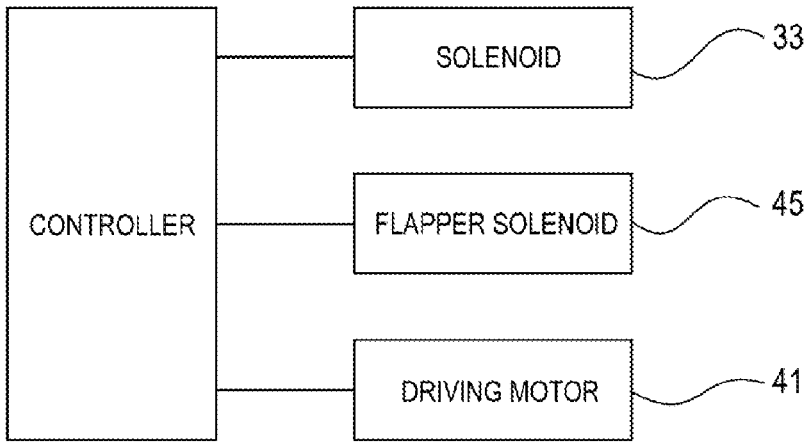
FIG. 7 is a control block diagram that controls the separating/feeding unit according to the embodiment.
Figure 8:
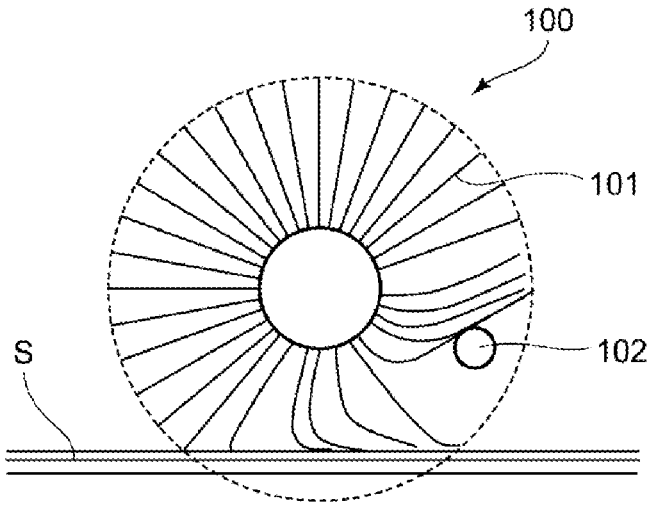
FIG. 8 PRIOR ART
FIG. 8 is a view illustrating a sheet feeding device using a paddle according to a related art.

FIG. 7 is a control block diagram for controlling the separating/feeding unit 3 and a controller C controls the solenoid 33 and the flapper solenoid 45 to be on/off and the driving motor 34 to be on/off.

Figure 4:
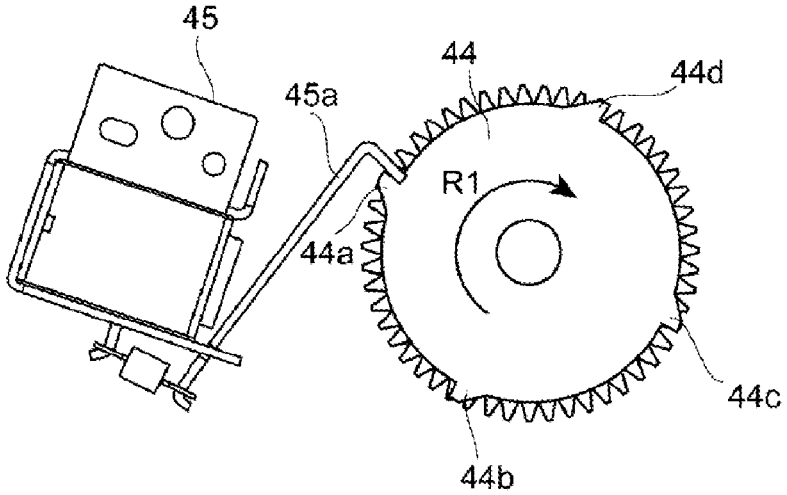
FIG. 4 is a view illustrating the input gear when the solenoid of the separating/feeding unit according to the embodiment is off.
Figure 6:
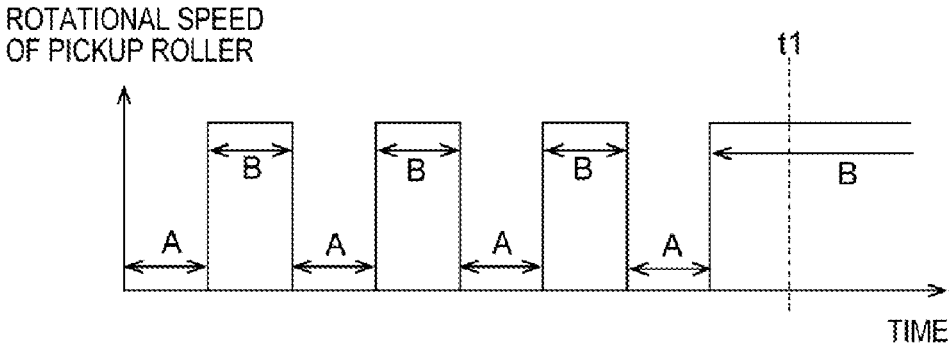
FIG. 6 is an explanatory view illustrating a driving timing of a pickup roller of the separating/feeding unit according to the embodiment.

Next, the separating/feeding operation of the separating/feeding unit 3 will be described with reference to FIGS. 3 to 6. FIG. 3 illustrates the input gear 44 when the flapper solenoid 45 of the separating/feeding unit 3 according to the embodiment is on. FIG. 4 illustrates the input gear 44 when the flapper solenoid 45 of the separating/feeding unit 3 according to the embodiment is off. FIG. 6 is an explanatory view illustrating a driving timing of the pickup roller 30 of the separating/feeding unit 3.

When a sheet feeding signal is input to the controller C to start the feeding operation of the sheet S by the sheet feeding portion 12, the solenoid 33 is controlled by the controller C so that the pickup roller 30 which waits in a retraction position moves to the abutting position. When the pickup roller 30 moves from the retract position to the abutting position, the pickup roller 30 abuts on a surface of a top sheet S so as to pressurize the sheet S accommodated in the sheet storage portion 21 from the top. When the pickup roller 30 abuts on the top sheet S, the controller C controls the driving motor 34 at a predetermined timing to start the drive and the driving force is transmitted from the driving motor 34 to the input gear 44 through the torque limiter 46, so that the input gear 44 rotates in a direction of an arrow R1 illustrated in FIG. 2.

In this case, as illustrated in FIG. 3, if the flapper solenoid 45 is on and the rotation of the input gear 44 is not regulated, that is, if the solenoid projection 45*a* is not engaged with the protrusions 44*a* to 44*d*, the input gear 44 rotates in a direction of the arrow R1 illustrated in FIG. 3. This is the same when the drive is transmitted from the stop state to be switched to the drive state. In this case, the torque limiter 46 is coupled to the driving motor 34 to start to rotate the input gear 44.

The driving force of the input gear 44 is transmitted from the intermediate gear 41 to the first gear 42 and the second gear 43 and also transmitted to the pickup roller 30 through the feed roller shaft 31*a* and the second drive transmission mechanism 5. When the driving force of the input gear 44 is transmitted to the pickup roller 30, the pickup roller 30 which is in a stop state starts the rotation against the static frictional force with the sheet S. In other words, the pickup roller 30 feeds the sheet S by the static frictional force stronger than the kinetic frictional force with the sheet S.

In the meantime, as illustrated in FIG. 4, if the flapper solenoid 45 is off and the rotation of the input gear 44 is regulated, that is, the solenoid projection 45*a* is engaged with any one of the protrusions 44*a* to 44*d*, the input gear 44 stops the rotation by the flapper solenoid 45. In this case, the torque limiter 46 runs idle and the transmission of the drive from the driving motor 34 to the input gear 44 is blocked.

The controller C controls the flapper solenoid 45 to be repeatedly on or off so that the solenoid projection 45*a* is sequentially engaged with the protrusions 44*a* to 44*d* of the input gear 44 to regulate the rotation of the input gear 44. Therefore, the pickup roller 30 is intermittently rotated. As illustrated in FIG. 6, until the fed sheet S reaches the separation nip N of the separating portion, the solenoid projection 45*a* is engaged with the protrusions 44*a* to 44*d* so that a time A when the pickup roller 30 is stopped is generated. Further, a time B when the pickup roller 30 rotates by the rotation of the input gear 44 when the flapper solenoid 45 does not regulate the input gear 44 is generated. The time A when the pickup roller 30 is stopped and the time B when the pickup roller 30 rotates are alternately generated and the pickup roller 30 is intermittently driven to repeat the rotation and stop. The intermittent rotation is repeated four times within a time t1 when it is assumed that the leading edge of the sheet S reaches the separation nip N of the separating portion. In this embodiment, for a rotational amount of the pickup roller 30 by one rotation of the input gear 44, a ratio of a gear of the drive transmission route is set such that the leading edge of the sheet reaches the separation nip N of the separating portion. Further, the number of times the pickup roller 30 intermittently is driven to repeat the rotation and stop may be appropriately set according to the number of protrusions 44*a* to 44*d*. Therefore, at least two protrusions are provided to repeatedly drive the pickup roller 30 twice or more.

By repeatedly and intermittently rotating the pickup roller 30 twice or more, even when the sheet S accommodated in the sheet storage portion 21 is hard to be separated due to the cutting burr formed by the cutting at the time of manufacture, the sheet may be separated. In other words, by rotating the pickup roller 30 from the stopped state, the sheet S is fed from the stopped state by the static frictional force with a large force. By repeating the above operation, the pickup roller 30 surely looses the sheet. As described above, when one sheet is fed, the pickup roller 30 repeatedly abuts on the sheet to perform the feeding operation so as to surely loose the sheet S and improve the separation performance in the separation nip N of the separating portion in the downstream.

When the pickup roller 30 intermittently rotates to perform the feeding operation and the leading edge of the sheet S reaches the separation nip N of the separating portion, the sheet S is fed in a sheet feeding direction by the separation nip N. When second and subsequent sheets reach the separation nip N continuously with the sheet S, the second and subsequent sheets are stopped at the separation nip N. Further, if the leading edge of the sheet S reaches the separation nip N of the separating portion, the pickup roller 30 is moved to the retraction position by the solenoid 33. Further, in the case of continuously feeding the sheets, the pickup roller 30 may perform the same intermittent rotation for the next sheet to feed the sheet while abutting on the next sheet in the abutting position without being moved to the retract position.

As described above, the image forming apparatus 1 according to the embodiment performs the intermittent rotation that alternately rotates and stops to rotate the pickup roller 30 that feeds the sheet S when the sheet accommodated in the sheet storage portion 21 is fed. Therefore, if it is difficult to separate the sheet S accommodated in the sheet storage portion 21 one by one due to the cutting burr formed by the cutting at the time of manufacture, the pickup roller 30 is intermittently rotated to separate the sheet.

The reason is because when the pickup roller 30 rotates from the stopped state to discharge the sheets, the sheet is fed by the static frictional force. Generally, since the static frictional force is larger than the kinetic frictional force (frictional force when the pickup roller 30 abuts on the sheet while rotating), when the sheet is fed using the static frictional force, if the sheet does not have the cutting burr, it is possible to efficiently loose the sheet. However, in the case of a sheet having the cutting burr, it is difficult to sufficiently loose the sheet. Therefore, in the sheet feeding apparatus in the related art that feeds the sheet S by the plurality of blades 101 of the rotating paddle wheel 100, the kinetic frictional force is applied when the blade 101 abuts on the sheet. Therefore, a large force is not applied to the sheet so that it is difficult to reliably separate the sheets combined by the cutting burr.

Here, by rotating the pickup roller 30 from the stopped state to repeat the operation that feeds the sheet S by the static frictional force twice or more, a large force by the static frictional force is applied to the sheet to reliably loose the sheet. In other words, since the static frictional force is larger than the kinetic frictional force, the pickup roller 30 may repeatedly perform the feeding operation on the sheet using a stronger force than the static frictional force to reliably loose the sheet S. Further, it is possible to improve the separation performance in the separation nip N of the separating portion in the downstream.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-265733, filed Dec. 5, 2011, which is hereby incorporated by reference herein in its entirety.

What is claimed is:

1. A sheet feeding device, comprising:

a sheet storage portion which accommodates a sheet;

a pickup roller which abuts on a surface of the sheet accommodated in the sheet storage portion to feed the sheet in a sheet feeding direction;

a driving motor which drives the pickup roller;

a separating/feeding portion, provided apart from the pickup roller in the sheet feeding direction, which includes a feed roller and a separation roller pressed with the sheet feeding roller which separates to separate and feed the sheet fed by the pickup roller;

a gear train which transmits a drive of the driving motor to the pickup roller;

an input gear, provided on the gear train, having a plurality of protrusions;

a regulating portion which is engaged with the protrusions of the input gear to regulate a rotation of the input gear;

an actuator which moves the regulating portion between an engaged position at which the regulating portion is engaged with the protrusions of the input gear to regulate the rotation of the input gear to stop the pickup roller and a disengaged position at which the regulating portion is disengaged from the protrusions to rotate the input gear to rotate the pickup roller;

a torque limiter which is provided in a transmission route of the driving motor and the input gear to block the transmission of the drive from the driving motor to the input gear when the regulating portion is in the engaged position and to transmit the drive from the driving motor to the input gear when the regulating portion is in the disengaged position, wherein when the regulating portion is in the engaged position, the transmission of the drive from the driving motor is blocked by the torque limiter to stop the rotation of the pickup roller; and a controller which controls the actuator so that, when the pickup roller abuts on the surface of the sheet accommodated in the sheet storage portion to feed the sheet, the actuator moves the regulating portion between the engaged position and the disengaged position alternately to allow the pickup roller to perform intermittent rotation that alternately performs rotation and stop twice or more before the sheet fed by the pickup roller reaches the separating/feeding portion.

2. The sheet feeding device according to claim 1, wherein the regulating portion is a flapper solenoid which is turned on or off based on a signal from the controller, and a solenoid projection of the flapper solenoid is engaged with the protrusions to stop the input gear.

3. An image forming apparatus comprising an image forming portion which forms an image on a sheet fed by a sheet feeding device, wherein the sheet feeding device includes:

a sheet storage portion which loads and accommodates a sheet;

a pickup roller which abuts on a surface of the sheet accommodated in the sheet storage portion to feed the sheet in a sheet feeding direction;

a driving motor which rotates the pickup roller;

a separating/feeding portion, provided apart from the pickup roller in the sheet feeding direction, which includes a feed roller and a separation roller pressed with the sheet feeding roller to separate and feed the sheet fed by the pickup roller;

a gear train which transmits a drive of the driving motor to the pickup roller, an input gear, provided on the gear train, having a plurality of protrusions;

a regulating portion which is engaged with the protrusions of the input gear to regulate a rotation of the input gear;

an actuator which moves the regulating portion between an engaged position at which the regulating portion is engaged with the protrusions of the input gear to regulate the rotation of the input gear to stop the pickup roller and a disengaged position at which the regulating portion is disengaged from the protrusions to rotate the input gear to rotate the pickup roller;

a torque limiter which is provided in a transmission route of the driving motor and the input gear to block the transmission of the drive from the driving motor to the input gear when the regulating portion is in the engaged position and to transmit the drive from the driving motor to the input gear when the regulating portion is in the disengaged position, wherein when the regulating portion is in the engaged position, the transmission of the drive from the driving motor is blocked by the torque limiter to stop the rotation of the pickup roller; and a controller which controls the actuator so that, when the pickup roller abuts on the surface of the sheet accommodated in the sheet storage portion to feed the sheet, the actuator moves the regulating portion between the engaged position and the disengaged position alternately to allow the pickup roller to perform intermittent rotation that alternately performs rotation and stop twice or more before the sheet fed by the pickup roller reaches the separating/feeding portion.

4. The image forming apparatus according to claim 3, wherein the regulating portion is a flapper solenoid which is turned on or off based on a signal from the controller, and a solenoid projection of the flapper solenoid is engaged with the protrusions to stop the input gear.

* * * * *